US009422757B2

(12) United States Patent
Bacchetti

(10) Patent No.: US 9,422,757 B2
(45) Date of Patent: Aug. 23, 2016

(54) HINGE FOR THE CONTROLLED ROTATABLE MOVEMENT OF A DOOR, IN PARTICULAR A GLASS DOOR

(71) Applicant: Luciano Bacchetti, Via Della Fonte (IT)

(72) Inventor: Luciano Bacchetti, Via Della Fonte (IT)

(73) Assignee: IN & TEC S.R.L., Brescia (IT)

( * ) Notice: Subject to any disclaimer, the term of this patent is extended or adjusted under 35 U.S.C. 154(b) by 0 days.

(21) Appl. No.: 14/880,252

(22) Filed: Oct. 11, 2015

(65) Prior Publication Data

US 2016/0160550 A1 Jun. 9, 2016

Related U.S. Application Data

(63) Continuation of application No. PCT/IB2014/060659, filed on Apr. 11, 2014.

(51) Int. Cl.

| | |
|---|---|
| ***E05D 5/02*** | (2006.01) |
| ***E05D 11/10*** | (2006.01) |
| ***E05D 3/02*** | (2006.01) |
| ***E05D 5/14*** | (2006.01) |
| ***E05D 11/08*** | (2006.01) |

(52) U.S. Cl.

CPC ..... *E05D 11/1028* (2013.01); *E05D 3/02* (2013.01); *E05D 5/14* (2013.01); *E05D 11/08* (2013.01); *E05D 11/1042* (2013.01); *E05D 2011/1035* (2013.01)

(58) Field of Classification Search

CPC ..... E05D 5/0246; E05D 2005/0261; E05D 2005/0269; E05D 7/081; E05D 7/08; E05Y 2900/114; E05Y 2600/502; E05Y 2600/60; E05F 11/385; E06B 3/54; A47K 3/362; A47K 2003/367; A47F 3/12; A47F 3/125; Y10T 16/534; Y10T 16/5326; Y10T 16/554; Y10T 16/547

See application file for complete search history.

(56) References Cited

U.S. PATENT DOCUMENTS

| | | | | |
|---|---|---|---|---|
| 5,867,869 | A * | 2/1999 | Garrett | A47K 3/36 16/252 |
| 5,867,871 | A * | 2/1999 | Tasman | E05D 11/1014 16/335 |
| 6,070,294 | A * | 6/2000 | Perkins | A47K 3/36 16/250 |

(Continued)

FOREIGN PATENT DOCUMENTS

| | | |
|---|---|---|
| DE | 8814708 U1 | 8/1989 |
| DE | 29618578 U | 12/1996 |

(Continued)

*Primary Examiner* — Chuck Mah

(74) *Attorney, Agent, or Firm* — Mark David Torche; Patwrite LLC

(57) ABSTRACT

A door hinge including a fixed element coupled to a wall; and a movable element coupled to the door. The fixed and movable elements are rotatably coupled to rotate between open and closed positions about a first axis. One of the movable and fixed elements includes a hinge body; the other of the movable and fixed elements includes a pivot and cam means. The hinge body includes a working chamber defining a second axis, which includes follower means interacting with the cam means to slide between first and second end-stroke positions. The cam means includes a flat face parallel to the first axis. The follower means includes an elastic element and an interface element having a first end interacting with the elastic element and a second end including a planar operating surface to come in contact with the flat face of the cam means to remain in contact and parallel.

13 Claims, 12 Drawing Sheets

(56) References Cited

U.S. PATENT DOCUMENTS

| | | | | | |
|---|---|---|---|---|---|
| 6,092,263 | A * | 7/2000 | Boue | E05D 3/12 | 16/286 |
| 6,161,255 | A * | 12/2000 | Garrett | A47K 3/36 | 16/284 |
| 6,704,966 | B1 * | 3/2004 | Kao | E05D 5/0246 | 16/252 |
| 7,305,797 | B2 * | 12/2007 | Chiang | E05D 5/0246 | 16/252 |
| 2002/0116787 | A1 * | 8/2002 | Miller | E05D 5/0246 | 16/252 |
| 2006/0207060 | A1 * | 9/2006 | Cheng | E05D 5/0246 | 16/252 |
| 2009/0070959 | A1 * | 3/2009 | Balenzano | E05D 5/0246 | 16/277 |
| 2009/0106937 | A1 * | 4/2009 | Bai | E05D 11/105 | 16/252 |
| 2010/0199459 | A1 * | 8/2010 | Bacchetti | E05D 5/0246 | 16/54 |
| 2012/0216370 | A1 * | 8/2012 | Chow | E05D 5/0246 | 16/54 |
| 2012/0279015 | A1 * | 11/2012 | Hung | E05F 3/12 | 16/297 |
| 2013/0000079 | A1 * | 1/2013 | Garrett | E05D 5/0246 | 16/319 |

FOREIGN PATENT DOCUMENTS

| | | | | |
|---|---|---|---|---|
| DE | 19623539 | A1 | 12/1997 | |
| FR | 2499618 | A1 | 8/1982 | |
| FR | 2907488 | A1 * | 4/2008 | E05D 11/1014 |
| IT | EP 2333212 | B1 * | 8/2014 | E05D 5/0246 |
| KR | 101403917 | B1 * | 6/2014 | |
| TW | CA 2466839 | A1 * | 11/2005 | E05D 5/0246 |

* cited by examiner

HINGE FOR THE CONTROLLED ROTATABLE MOVEMENT OF A DOOR, IN PARTICULAR A GLASS DOOR

FIELD OF INVENTION

The present invention is generally applicable to the technical field of the closing or damping/control hinges, and particularly relates to a hinge for the controlled rotatable movement of a door, in particular a glass door.

BACKGROUND OF THE INVENTION

As known, the hinges for glass doors generally comprise a movable element to be fixed to the door, which movable element is hinged on a fixed element, fixed to a support frame.

An example of such known hinges is shown in the document DE29618578U, which shows a hinge in which the door once opened is automatically closed by swinging several times around the closed position.

The absence of control makes this hinge extremely dangerous, because during the swing the door could hit an object or a person, thus breaking. It is apparent that in the case a person is close to the door, such a break may more or less seriously hurt him.

Moreover, this known hinge tends to lose the starting position and/or to misalign.

SUMMARY OF THE INVENTION

An object of the present invention is to overcome at least partly the above mentioned drawbacks, by providing a hinge having high performances, simple construction and low cost.

Another object of the invention is to provide a hinge which allows controlling the movement of the door upon its opening and/or its closing.

Another object of the invention is to provide a strong and reliable hinge.

Another object of the invention is to provide a hinge having extremely small dimensions.

Another object of the invention is to provide a hinge that has a minimum number of constituent parts.

Another object of the invention is to provide a hinge suitable to maintain the exact closing position during time.

Another object of the invention is to provide a hinge that is safe.

Another object of the invention is to provide a hinge that is easy to install.

Another object of the invention is to provide a hinge that simplifies the operations of maintenance and/or replacement thereof.

Another object of the invention is to provide a hinge which allows a simple adjustment of the door to which it is connected.

These objects, as well as other which will appear clearer hereafter, are fulfilled by a hinge having one or more of the features herein disclosed, claimed and/or shown.

Advantageous embodiments of the invention are defined in accordance with the dependent claims.

BRIEF DESCRIPTION OF THE DRAWINGS

Further features and advantages of the invention will appear more evident upon reading the detailed description of some preferred, non-exclusive embodiments of a hinge 1, which is described as non-limiting examples with the help of the annexed drawings, in which.

DETAILED DESCRIPTION OF SOME PREFERRED EMBODIMENTS

With reference to the above figures, the hinge according to the invention, generally indicated 1, is particularly useful for the rotatable possibly controlled movement during opening and/or closing of a door, in particular a glass door, which may be anchored to a stationary support structure, such as a wall or a frame.

The embodiments of hinges 1 herein shown are adapted to be mounted to a frame of a glass door through a plate P. The embodiment shown in FIGS. 1 to 3C differs from the one shown in FIGS. 4 to 8D for the fact that the latter has means for adjusting the position of the door when the same is in closed position. The embodiment shown in FIGS. 10 to 17B differs from the others for the shape of the cam means 50 and the follower means 60.

Figure 1:
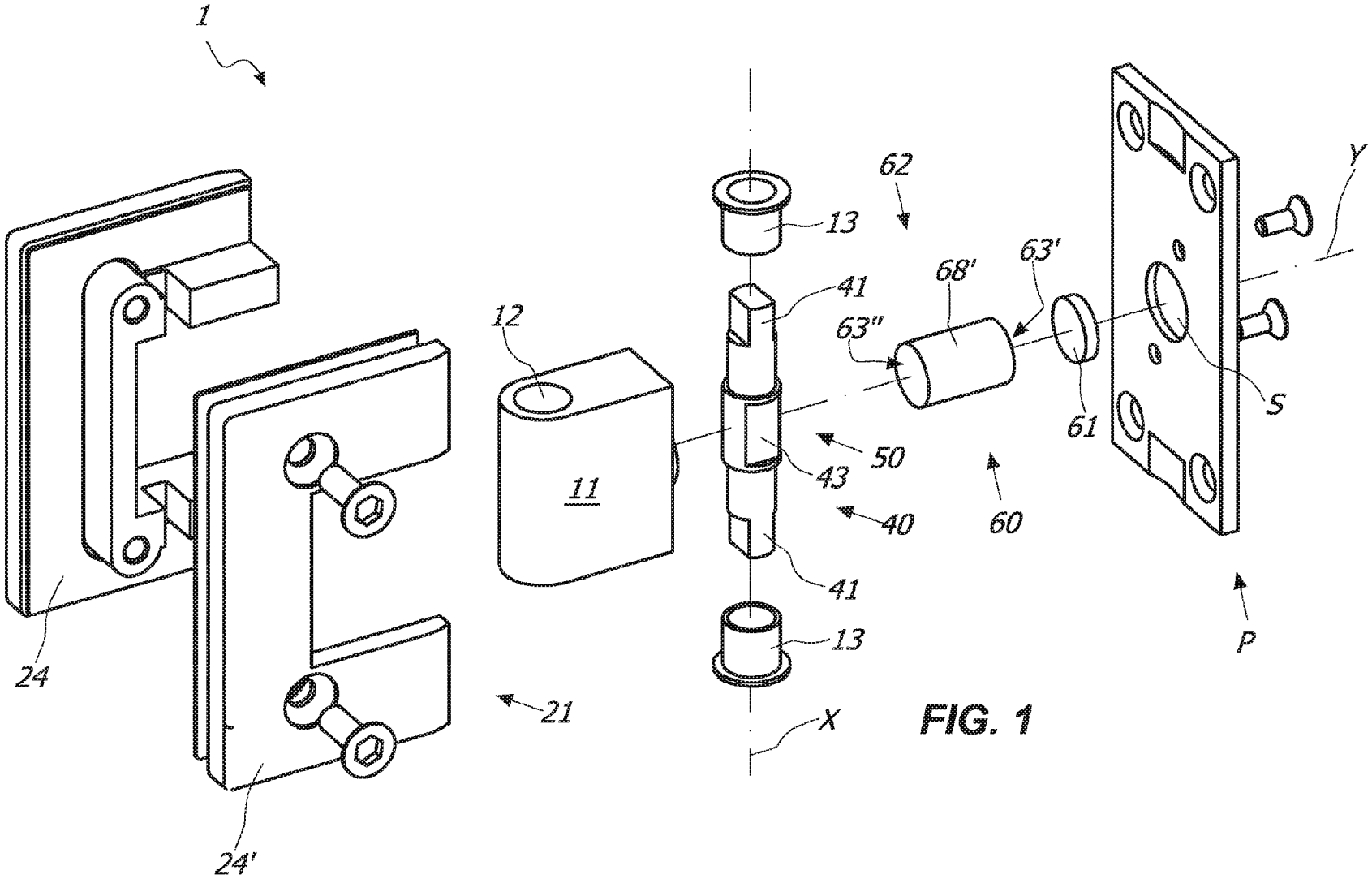
FIG. 1 is an exploded view of a first embodiment of the hinge 1.
Figure 2A:
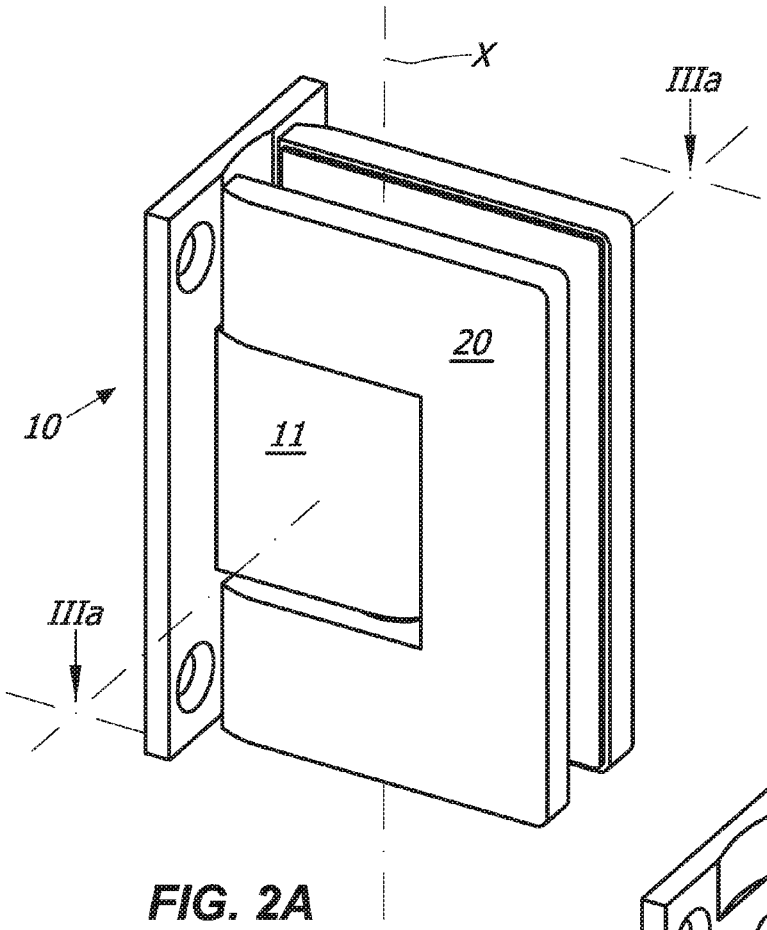
FIGS. 2A and 2B are perspective views of the embodiment of the hinge 1 of FIG. 1 respectively in a closed and open position.
Figure 2B:
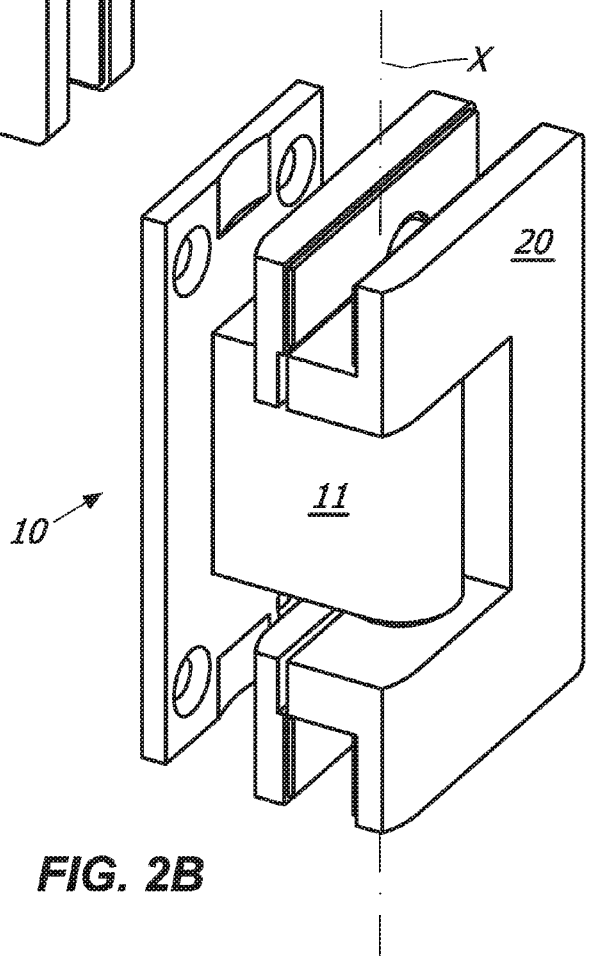
Figure 3A:
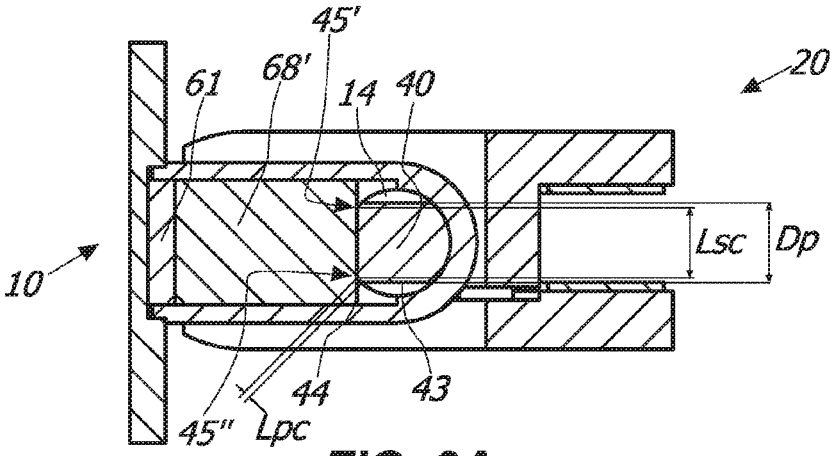
FIGS. 3A, 3B and 3C are sectioned views of the embodiment of the hinge 1 of FIG. 1 respectively in a closed, partly open and fully open position, the section being taken along a plane IIIa-IIIa.
Figure 3B:
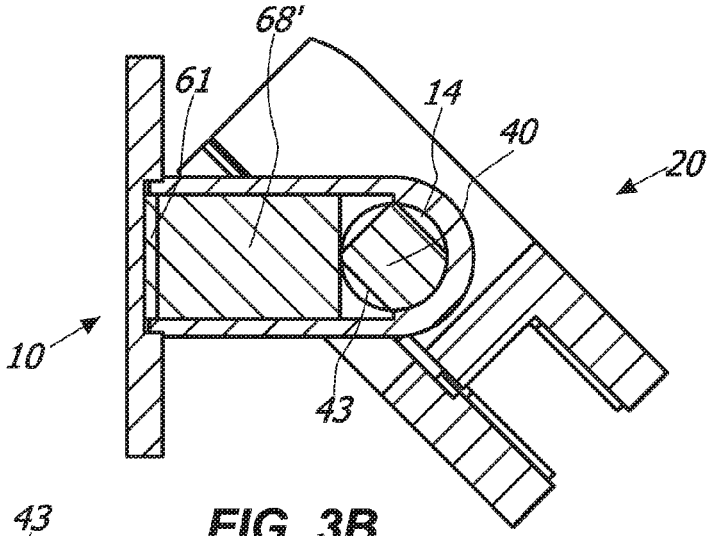
Figure 3C:
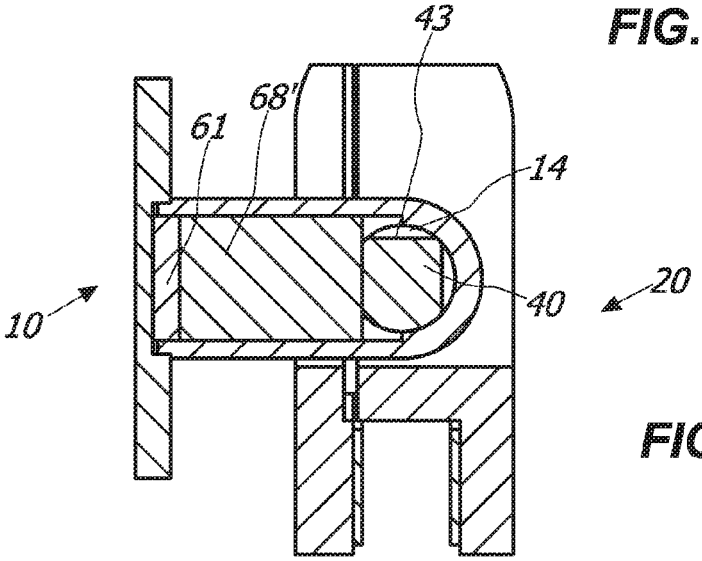
Figure 4:
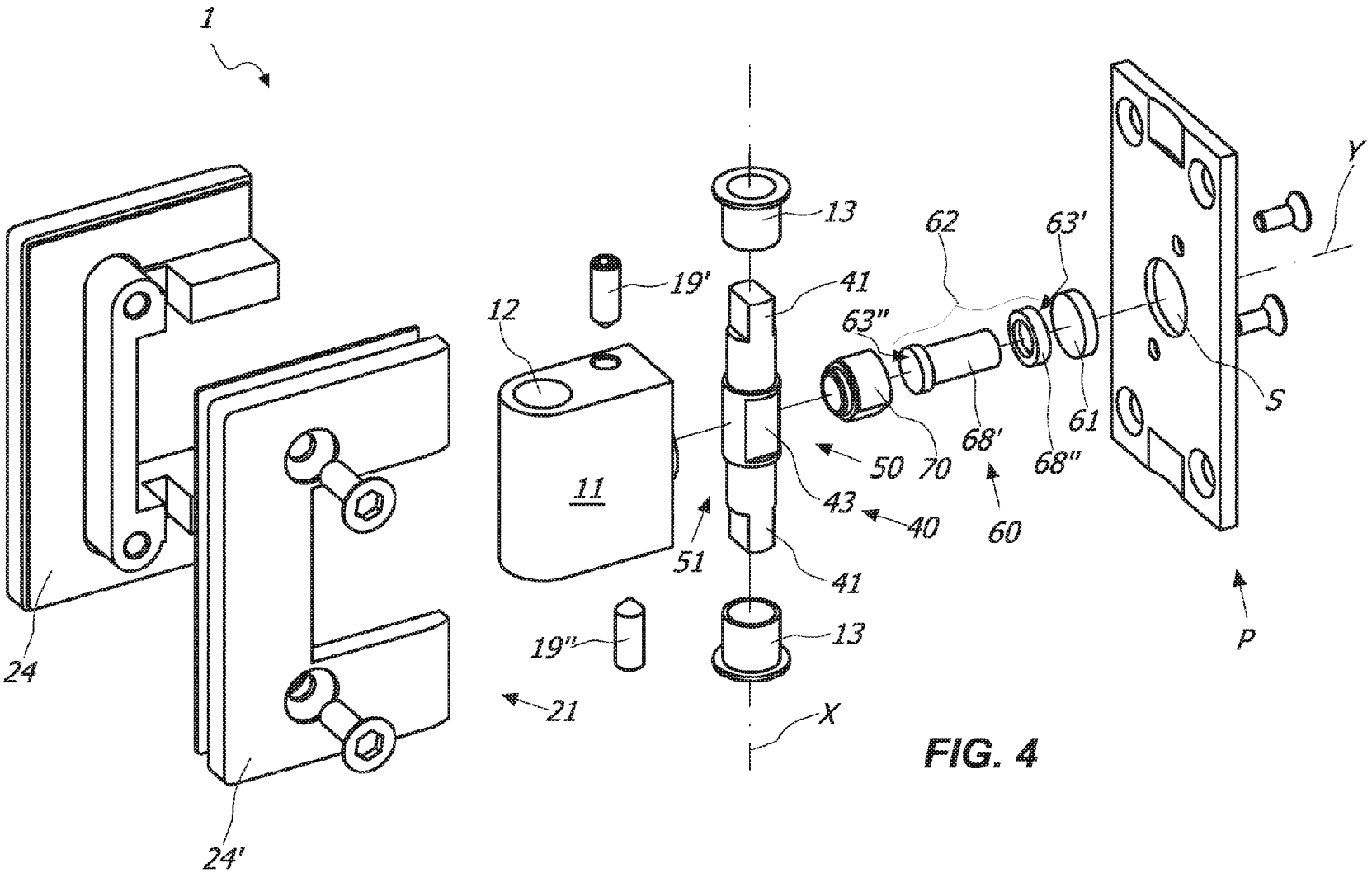
FIG. 4 is an exploded view of a further embodiment of the hinge 1.
Figure 5A:
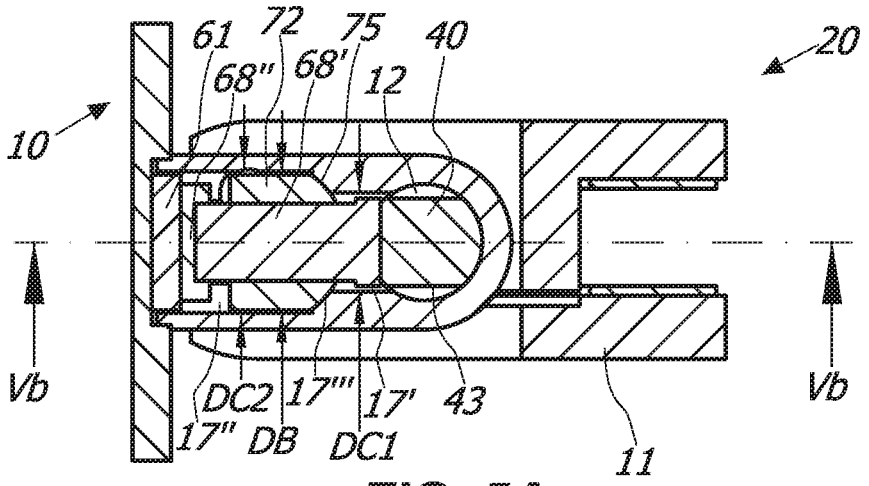
FIGS. 5A and 5B are sectioned views of the embodiment of the hinge 1 of FIG. 4 in the closed position, the sections being taken along planes Va-Va and Vb-Vb.
Figure 5B:
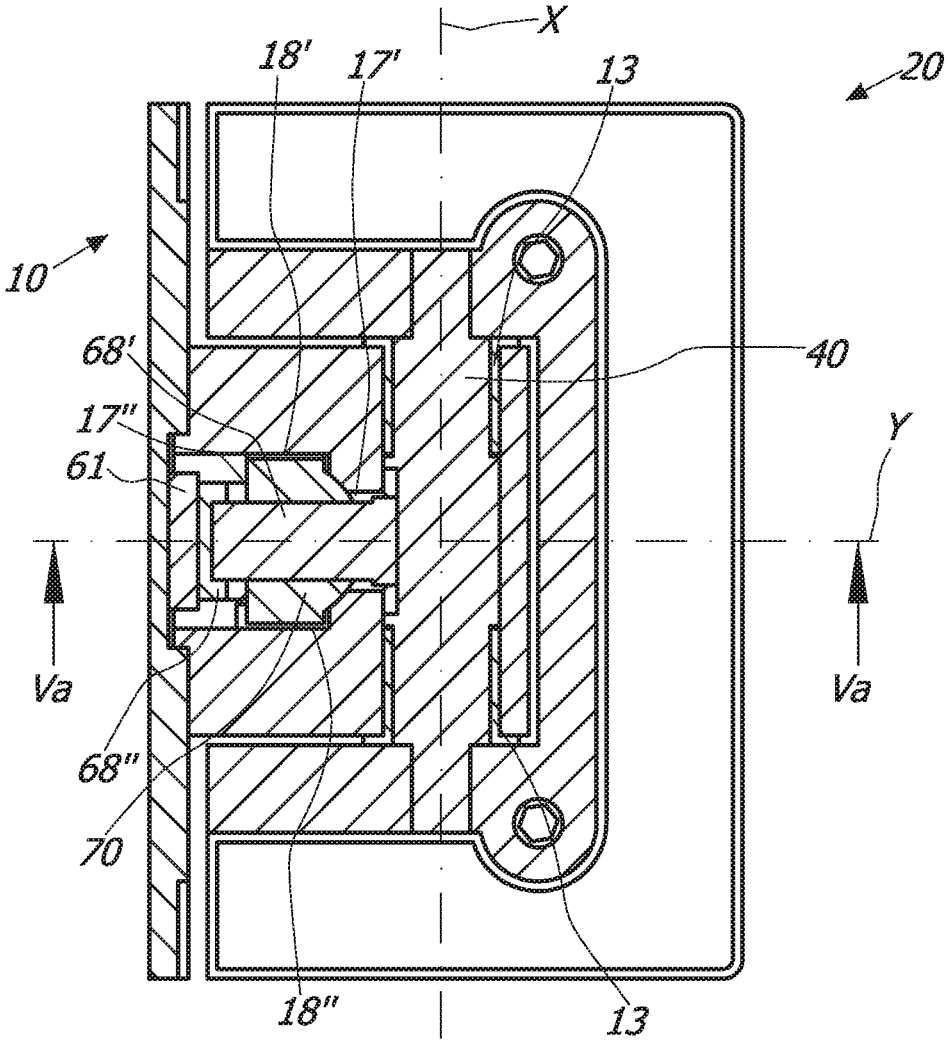
Figure 6A:
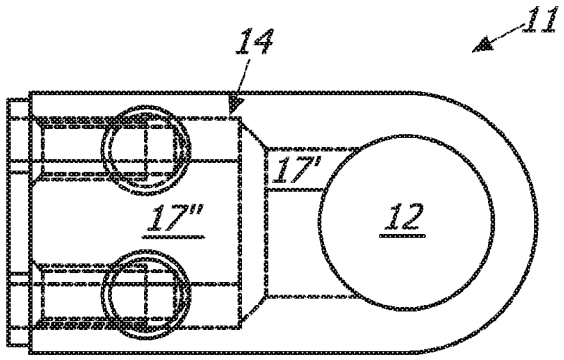
FIGS. 6A, 6B and 6C are respective top, side and front views of the embodiment of the hinge 1 of FIG. 4.
Figure 7:
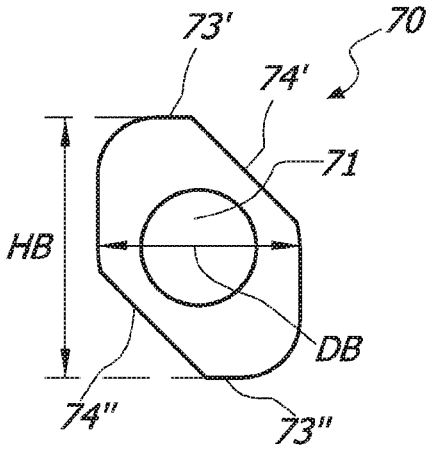
FIG. 7 is a front view of the bushing 70 of the embodiment of the hinge 1 of FIG. 4.
Figure 6C:
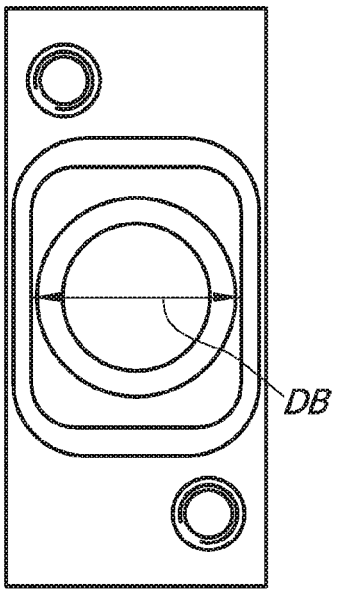
Figure 6B:
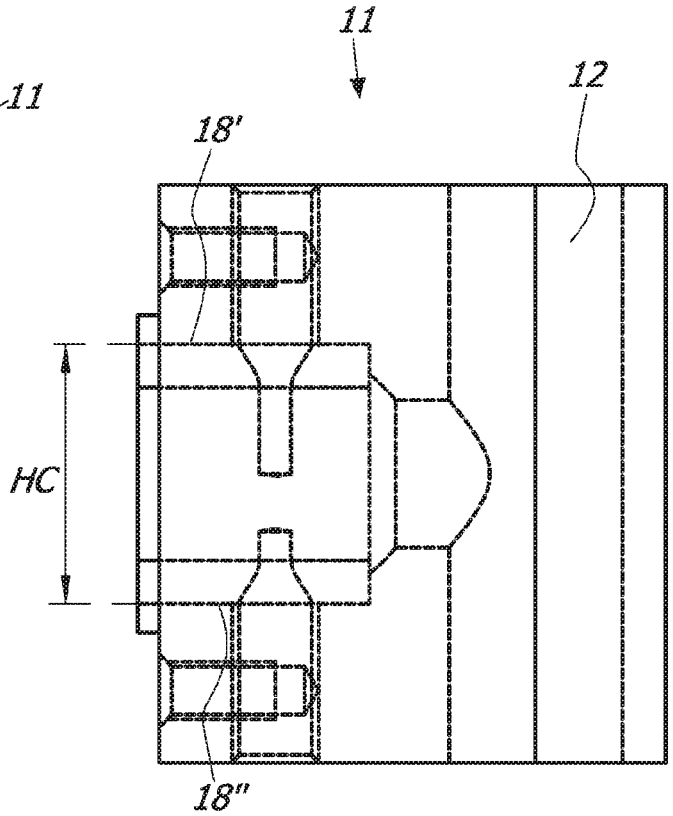

Conveniently, the hinge 1 may include a fixed element 10, which may be fixed to the stationary support, on which a movable element 20 is pivoted to rotate about a longitudinal axis X, which may be substantially vertical, between an open position, shown for example in FIGS. 2B, 3B and 3C and a closed position, shown for example in FIGS. 2A and 3A.

Advantageously, the fixed element 10 may include a box-shaped hinge body 11 anchored to the stationary support, while the movable element 20 may include means 21 for fixing to the glass door. In particular, in a per se known manner, the fastening means 21 may be defined by a pair of clamps 24, 24' adapted to mutually cooperate to clamp a glass door.

Suitably, the hinge body 11 may include a passing-through seat 12 defining the axis X within which is inserted with minimal clearance the pivot 40, which may be connected to the fixing means 21.

The pivot 40 may have both ends 41 mutually connected with the fixing means 21. In this way, the pivot 40 is unitary movable with the door between the open and closed positions.

Suitably, at the ends of the passing-through seat 12 of the box-shaped body 11 respective anti-friction elements 13 may be placed, such as bushings.

This allows the movable element 20 to rotate about the axis X with minimum friction, so that the hinge 1 is able to support even very heavy doors.

The hinge body 11 may internally include a working chamber 14 defining a second axis Y which is substantially perpendicular to the first axis X defined by the passing-through seat 12 for the pivot 40.

Suitably, the pivot 40 may include cam means 50 rotating around the axis X, while the working chamber 14 may include follower means 60 interacting with the former to slidably move along the axis Y between a first and a second end-stroke position, shown for example in FIGS. 3A and 3B.

The follower means 60 may include an elastic counteracting element adapted to elastically oppose the pushing force imparted by the cam means. As non-limiting example, the elastic counteracting element may include, respectively may consist of, a spring, a nitrogen cylinder or a portion of polymeric material.

In a preferred but not exclusive embodiment of the hinge 1, the elastic counteracting element may consist of an elastomer body 61, which may be plate-shaped, disk-shaped or cylindrical-shaped.

Advantageously, the elastomer body 61 may be made of a polyurethane elastomer of the compact type, for example Vulkollan®. Suitably, the elastomer may have a Shore A hardness of 50 ShA to 95 ShA, preferably of 70 ShA to 90 ShA. More preferably, the elastomer body 61 may have a Shore A hardness of 80 ShA.

The use of the elastomer body 61 in place of the classic spring allows for secure stopping of the glass door without oscillations around the closed position.

Therefore, the hinge 1 is particularly safe, economical and long lasting in time. Moreover, the hinge 1 requires minimum maintenance and is extremely easy to install.

In the embodiments herein shown, the elastomer body 61 is used as urging member, in order to urge each towards the other the cam means 50 and the follower means 60 and to maintain the latter in the stop door positions, as better explained later.

Suitably, the elastomer body 61 may have discoidal shape, and may be housed in a seat S of the plate P.

In fact the plate P, in addition to allowing the connection of the hinge 1 to the stationary support structure, also acts as closing cap for the working chamber 14.

Moreover, the follower means 60 may advantageously include an interface element 62 having a first end 63' which interacts with the elastic counteracting element 61 and a second end 63" interacts with the cam means 50.

In the embodiment shown in FIGS. 1 to 3C and 10 to 17B, the interface element 62 may be a single piece of generally cylindrical or discoidal shape, and configured as a pushing member 68'.

In the embodiment shown in FIGS. from 4 to 8D, the interface element 62 may be composed of two pieces, a pushing cylinder 68' and a pressure disc 68" inserted in a bushing 70, the function of which is better explained later.

Suitably, the pivot 40 may include the cam means 50, so that the latter rotate unitary with the former around the axis X. The cam means 50 may in turn include one or more cam elements adapted to interact with the follower means 60.

In a preferred but not exclusive embodiment, the cam means may be defined by a plurality of flat faces 43 formed at the central portion of the pivot 40.

The relative angle between the flat faces of the cam means determines the stop positions of the door.

In particular, in the embodiments shown herein, the flat faces 43 may be three, mutually perpendicular each other to define an equal number of stop door positions, in the closed position and the open ones in both possible directions.

In fact, the elastomer body 61 pushes the pushing cylinder 68' against the flat faces 43 formed at the central portion of the pivot 40, so as to maintain the relative door open or closed positions.

To this end, the interface element 62 may have the second end 63" that includes a substantially planar operating surface 66 susceptible to come in contact with the substantially planar faces 43.

In this way, in the stop positions of the door the substantially planar operating surface 66 is parallel to the flat face 43 by which it interacts, in order to ensure the stability of the position.

It is understood that in this document the terms "flat face" and "planar surface" and their derivatives indicate faces or surfaces whose geometry, even if not actually flat or planar, is equivalent thereto.

Figure 9:
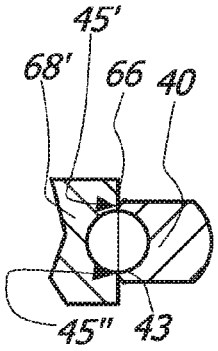
FIG. 9 is a sectional view of an alternative configuration of the pivot 40 and the pushing cylinder 68', equivalent to the one shown in FIGS. 3A, 3B and 3C.

FIG. 9 shows a flat face 43 and a planar operating surface 66 which, although not actually flat, are equivalent to faces or surfaces flat or planar. Indeed, their geometry is such that the edges 45', 45" of the face 43 defines a flat surface resting on the operating surface 66.

It is understood that any other geometry or configuration adapted to provide a flat surface or face falls within the scope of protection of the appended claims.

Advantageously, in the stop positions the flat faces 43 may be mutually in contact with the substantially planar operating surface 66 throughout all its width, as shown for example in FIGS. 3A and 3C.

To ensure the stability of the stop position even in the event of accidental knocks to the door, the length Les of the contact surface between the substantially planar operative surface 66 and the substantially flat faces 43 may be slightly less than the diameter Dp of the pivot 40.

Suitably, the ratio Les/Dp between the length Les above and the diameter Dp of the pivot 40 may be not less than 0.8, and preferably equal to or greater than 0.85.

Due to this feature, the hinge 1 is extremely safe, in particular in those applications in which there is a danger that an unwary user inadvertently bumps the door. In fact, in the case of glass door this may result in the breaking of the door and the consequent injury of the user.

To maximize this effect, in a preferred but not exclusive embodiment, between the substantially planar faces 43 a connecting portion 44 may be interposed having a width Lpc substantially less than the one Lsc of the same flat faces 43. Preferably, the connecting portion 44 may have non-planar shape, for example a rounded shape.

This results in the maximum possible compression of the elastic counteracting element 61. In other words, to move from a stop position to another the user must exert a relatively high force on the door, thus minimizing the risk that small bumps may move the door with the above consequences.

Suitably, the ratio between the width Lpc of the connection portion 44 and the one Lsc of the flat faces 43 may be not more than 0.2, and preferably less than 0.15.

In another preferred but not exclusive embodiment, the interface element 62 may be configured as a pushing member 68' and include a protrusion 300, having a generally hemispherical shape. On the other hand, the cam means 50 may include a plurality of seats 310, 320, 330 each corresponding to a stop position of the door.

More in particular, the seats 310, 320, 330 are able to receive the positions 300 to stop the door in the stop positions.

Suitably, the seat 310 may correspond to the closed door position, while the seats 320, 330 may correspond to the open door positions. Advantageously, the latter may be mutually opposite with respect to the closed door position.

In a preferred but not exclusive embodiment, the seat 310 corresponding to the closed door position may have a generally "V"-shape with two consecutive planes 311, 312 angled each other with predetermined angle.

Figure 13B:
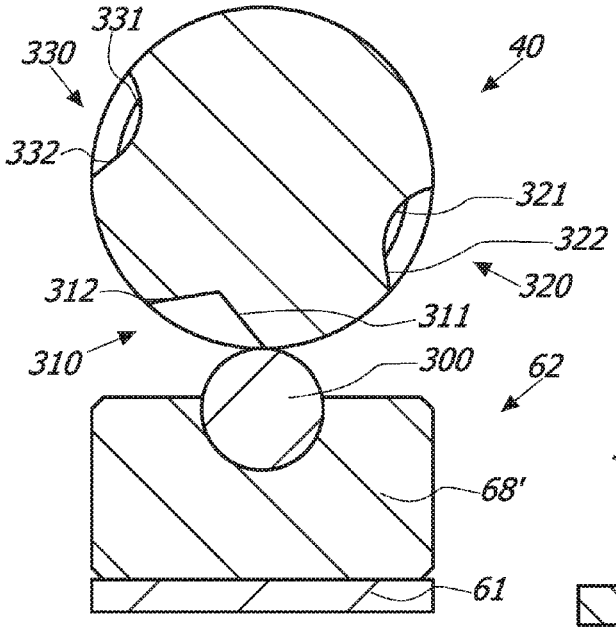
FIG. 13B is an enlarged view showing the relative position of the cam means 50 of FIG. 13A, the pushing member 68' and the elastic counteracting element 61.
Figure 13A:
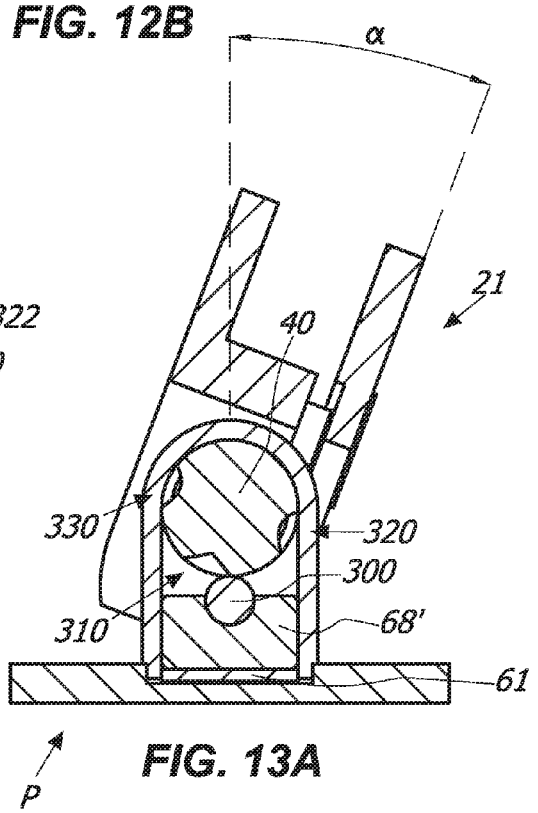
FIG. 13A is a sectional view of the embodiment of the hinge 1 of FIG. 10 in a second operating step.

In this way, as particularly shown in FIG. 13A, the sliding of the hemispherical protrusion 300 on the planes 311, 312 upon the rotation of the door is simplified, so as to ensure the automatic closing of the door starting from a predetermined angle α, for example 20°.

At the same time, user can rotate the door from the closed door position in both opening directions.

To maximize this effect, the angle between the planes 311, 312 may be at least 90°, preferably at least 110°. In a preferred but not exclusive embodiment, the angle between the planes 311, 312 may be 120°.

Moreover, each of the seats 320, 330 corresponding to the open door positions may advantageously have two consecutive portions 321, 322; 331, 332 having different shape.

The first portions 322; 332 may be generally flat, while the second portions 321; 331 may be countershaped with respect to the shape of the protrusion 300, and in particular may be hemispherical.

In this way, the first flat portions 322; 332 may promote the sliding of the projection 310 thereon to convey it towards the second portions 321; 331, suitable to stop the door.

Figure 14A:
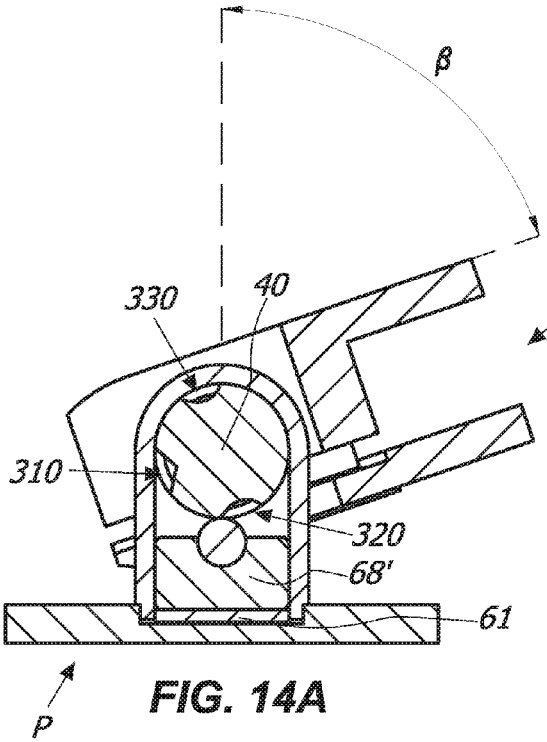
FIG. 14A is a sectional views of the embodiment of the hinge 1 of FIG. 10 in a third operating step.
Figure 14B:
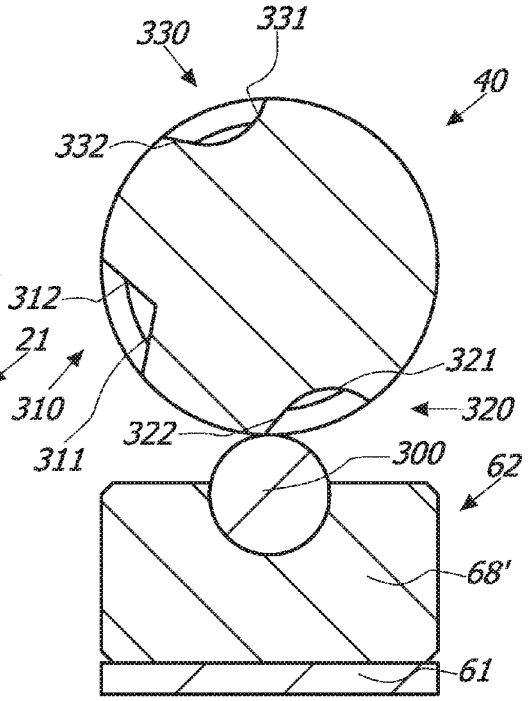
FIG. 14B is an enlarged view showing the relative position of the cam means 50, the pushing member 68' and the elastic counteracting element 61 of FIG. 14A.

In this way, as particularly shown in FIG. 14A, the automatic opening of the door starting from a predetermined angle for example 70°, is ensured.

Figure 15A:
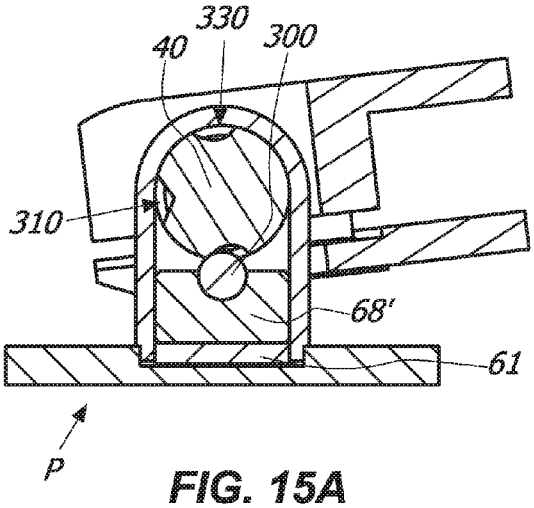
FIG. 15A is a sectional view of the embodiment of the hinge 1 of FIG. 10 in a fourth operating step.
Figure 15B:
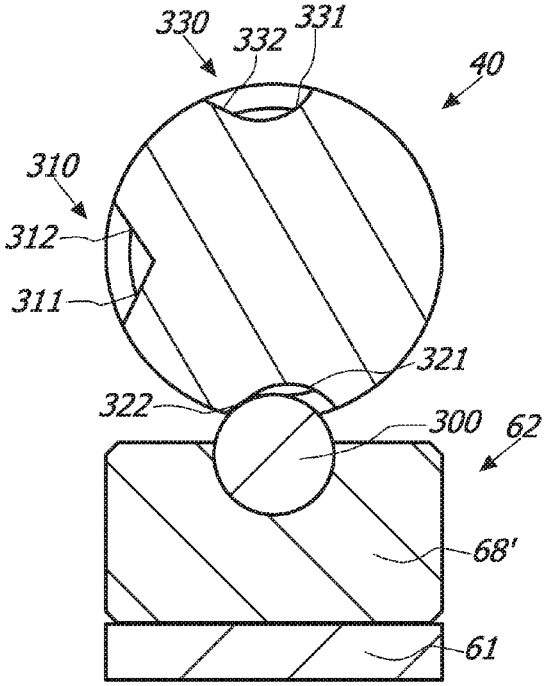
FIG. 15B is an enlarged view showing the relative position of the cam means 50, the pushing member 68' and the elastic counteracting element 61 of FIG. 15A.
Figure 16A:
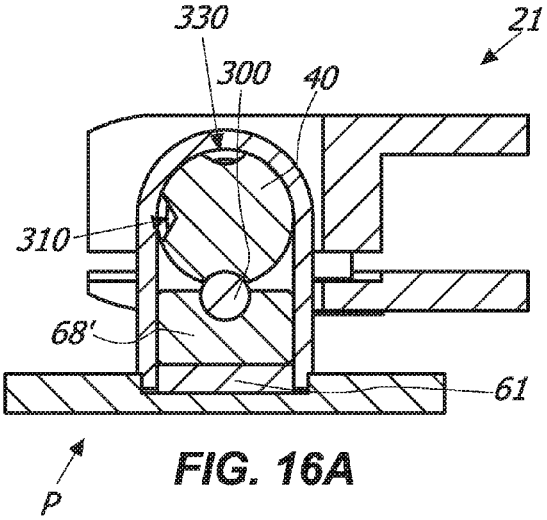
FIG. 16A is a sectional views of the embodiment of the hinge 1 of FIG. 10 in a fifth operating step.
Figure 16B:
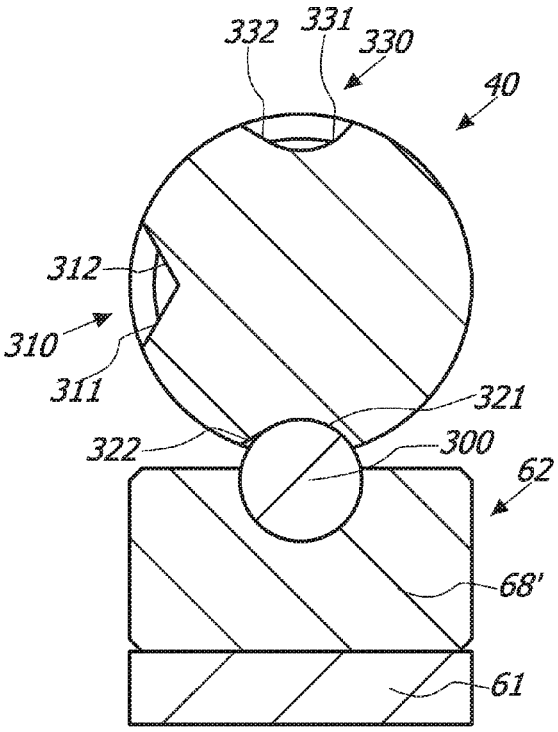
FIG. 16B is an enlarged view showing the relative position of the cam means 50, the pushing member 68' and the elastic counteracting element 61 of FIG. 16A.

As particularly shown in FIGS. 15A and 15B, the first flat portions 322; 332 act as pilot members for the second hemispherical portions 321; 331, an that the insertion of the protrusion 300 in the latter takes place without noise.

Advantageously, the first flat portions 322; 332 may be substantially perpendicular to the planes 312, 311.

Moreover, thanks to the above configuration the door may be rotated from the stop position only in one direction. In other words, the rotation in the other direction is prevented.

Figure 17A:
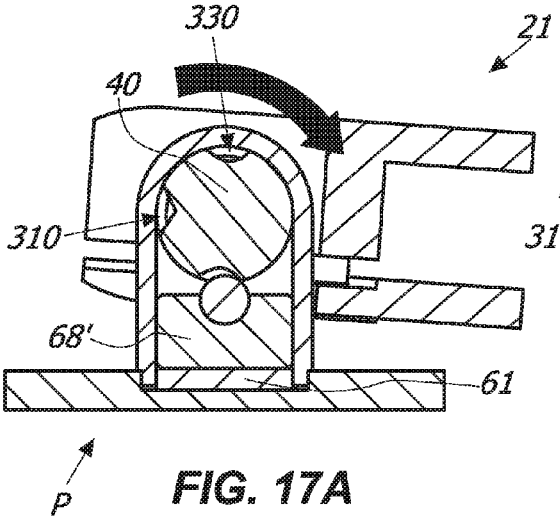
FIG. 17A is a sectional views of the embodiment of the hinge 1 of FIG. 10 in a sixth operating step.
Figure 17B:
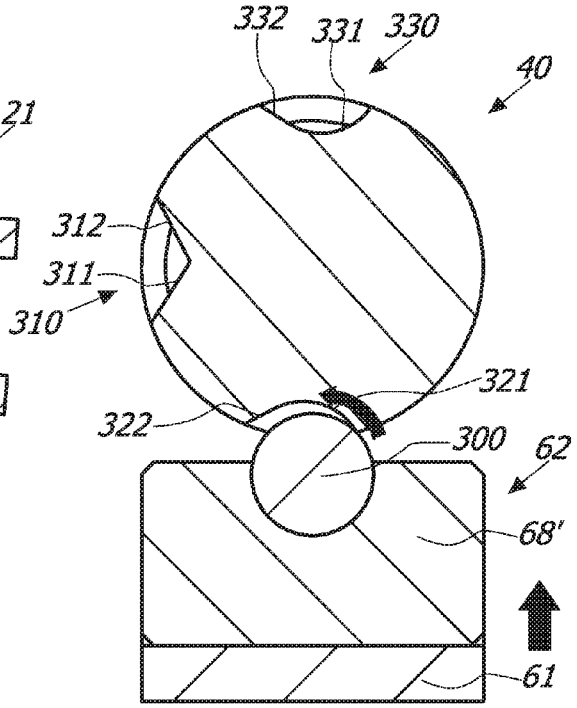
FIG. 17B is an enlarged view showing the relative position of the cam means 50, the pushing member 68' and the elastic counteracting element 61 of FIG. 17A.

Indeed, as shown in FIG. 17B, if a user attempts to further rotate the door, the momentum caused by the elastic counteracting element 61 opposes this force, which momentum urges the one against the other the protrusion 300 and the second portions 321; 331.

Suitably, the elastic counteracting element 61 may be configured so as to allow a further slight rotation of the door after the stop position in the door open position. To this end, the elastic counteracting element 61 after this minimum rotation can reach the position of maximum compression.

This absorbs the shock undergone by the door upon the reaching of the stop position. This configuration is particularly advantageous in the case of glass door, which in the case of abrupt shock could be damaged or broken.

The embodiment shown in FIGS. 10 to 17B and described above is particularly advantageous with the above described elastic counteracting element 61 made of elastomer.

In fact, in the latter a minimum stroke corresponds to a very high strength.

Therefore, suitably precompressing the elastic counteracting element 61 in the working chamber 14 the strength of the hinge 1 is maximized.

Also, the elastic counteracting element 61 made of elastomer maximizes the effect of stopping the rotation, as described above.

The shape of the cam means 50 determines the stroke of the elastomer body 61. In particular, the cam element may be configured so that the stroke can be of 1 mm to 5 mm, and preferably of 1 mm to 3 mm.

In the embodiment of the hinge 1 shown in FIGS. 4 to 8D is possible to adjust the position of the movable element 20 in the closed door position.

For this purpose, a bushing 70 may be provided with a central hole 71 which houses the pushing cylinder 68'. The bushing 70 may include a tubular portion 72 having an outer diameter DB and a height HB. The bushing 70 may further have substantially flat upper and lower surfaces 73', 73", and slanted peripheral portions 74', 74".

On the other hand, the working chamber 14 may include a first tubular portion 17' having a first inner diameter DC1 and a second portion 17" of generally rectangular shape and transverse dimension DC2 and height HC.

The bushing 70 may be inserted into the working chamber 14 with the tubular portion 72 placed in correspondence of the second portion 17" of the same working chamber 14.

The outside diameter DB of the portion 72 of the bushing 70 may be slightly less than the inside diameter DC2 of the portion 17" of the working chamber 14. The height HB of the portion 72 of the bushing 70 may be substantially equal to the height HC of the second portion 17" of the working chamber 14.

The connecting portion 17'" between the two portions 17' and 17" of the working chamber 14 may be suitably rounded, as well as the corresponding operating portion 75 of the bushing 70.

Thanks to this configuration, the bushing 70 is free to transversely move once inserted in the working chamber 14. The stroke of this movement is defined by the difference between the outer diameter DB of the portion 72 of the bushing 70 and the inner diameter DC2 of the portion 17" of the working chamber 14. During this movement, the bushing 70 is horizontally guided by the sliding of the substantially flat upper and lower surfaces 73', 73" on the walls 18', 18" of the portion 17" of the working chamber 14, which is also flat.

To adjust the movement, adjusting screws 19', 19" may be provided acting on the slanted portions 74', 74". In practice, the adjusting screws 19', 19" act in a substantially vertical direction, and the inclined planes defined by the slanted portions 74', 74" transmit the horizontal component of the pushing force to the bushing 70, thus causing the shift thereof in the portion 17" the working chamber 14.

Figure 8B:
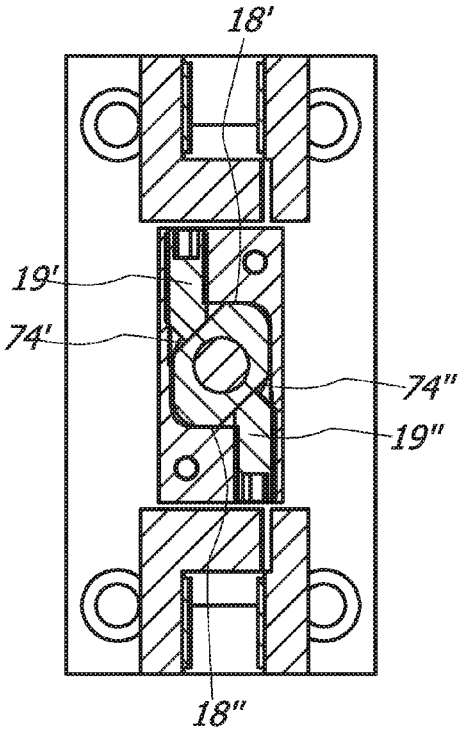
FIGS. 8A, 8B, 8C and 8D are respective side, sectioned along a plane VIIIb-VIIIb, sectioned along a plane VIIIc-VIIIc and enlarged views of the embodiment of the hinge 1 of FIG. 4 in an operative configuration.
Figure 8A:
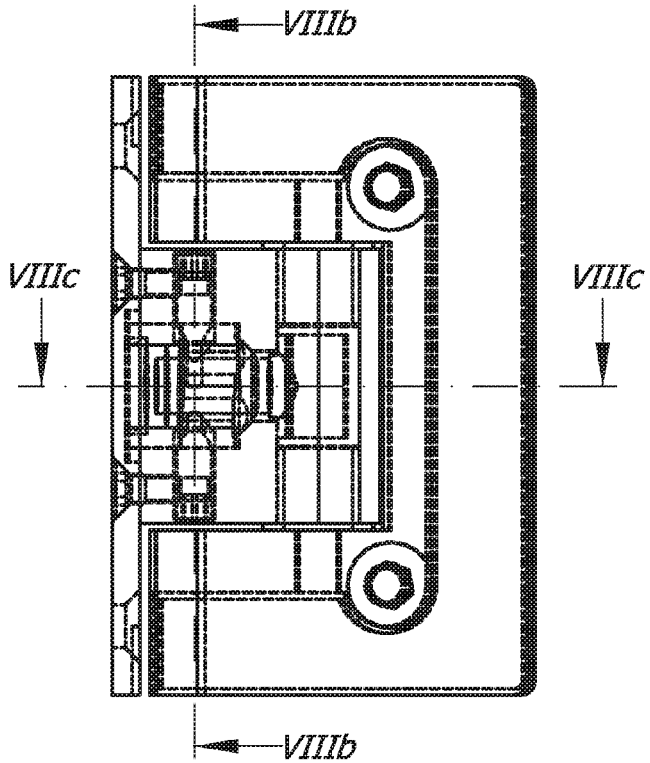
Figure 8C:
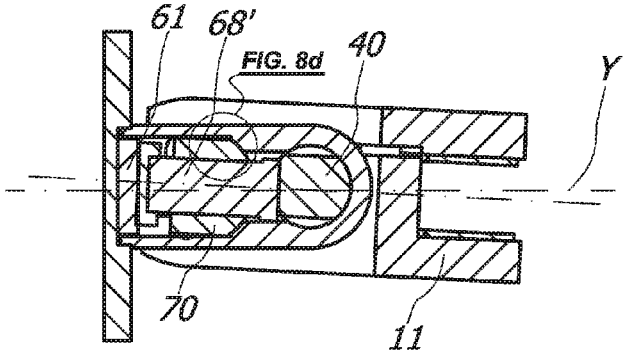
Figure 8D:
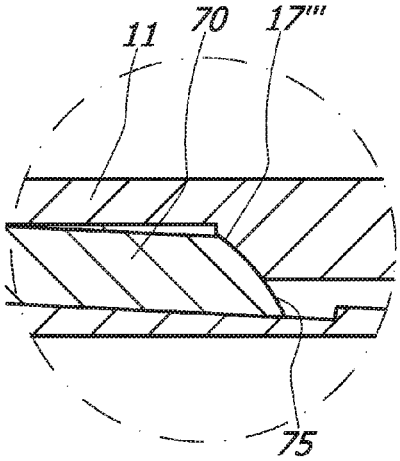
Figure 10:
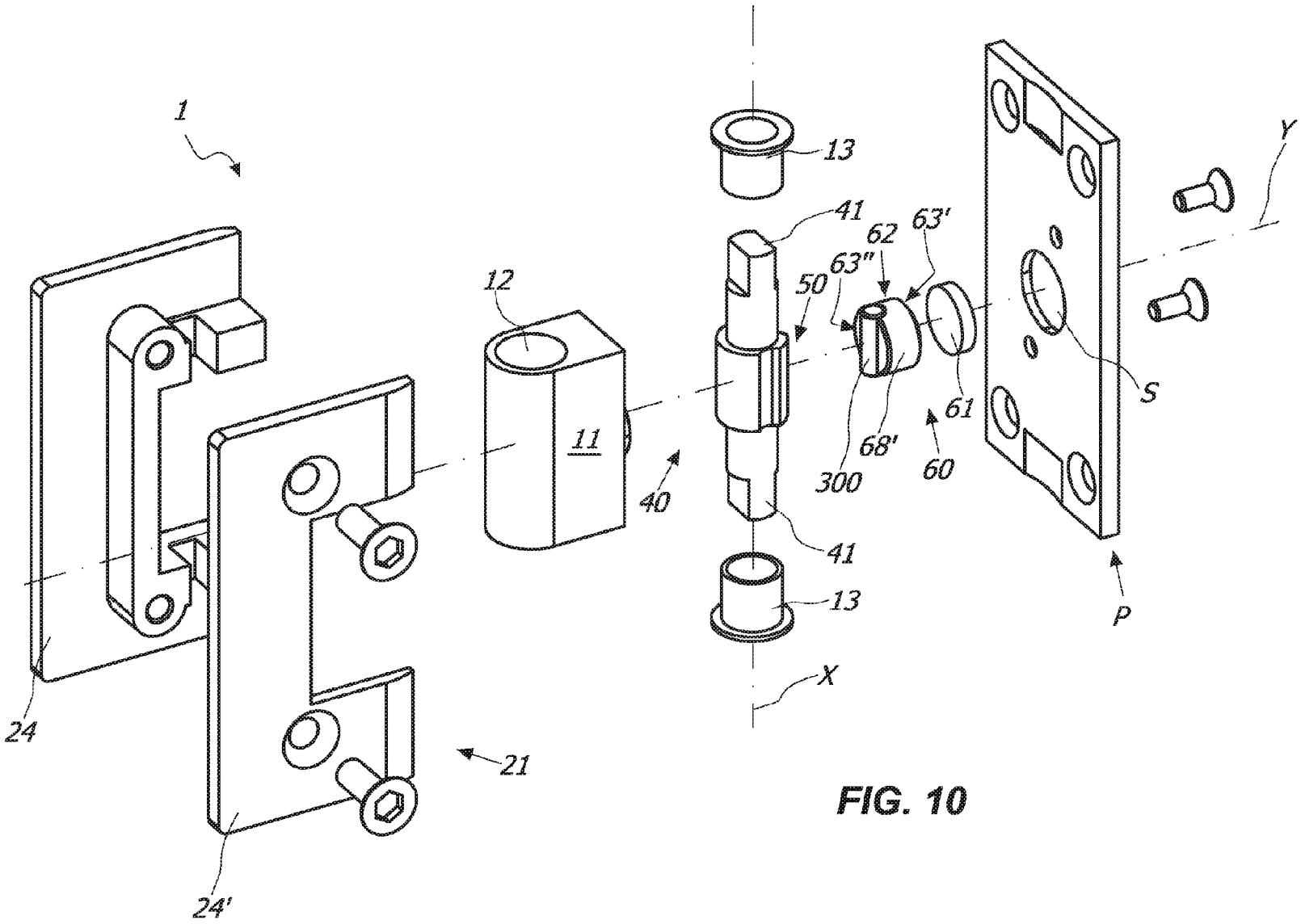
FIG. 10 is an exploded view of a further embodiment of the hinge 1.
Figure 11A:
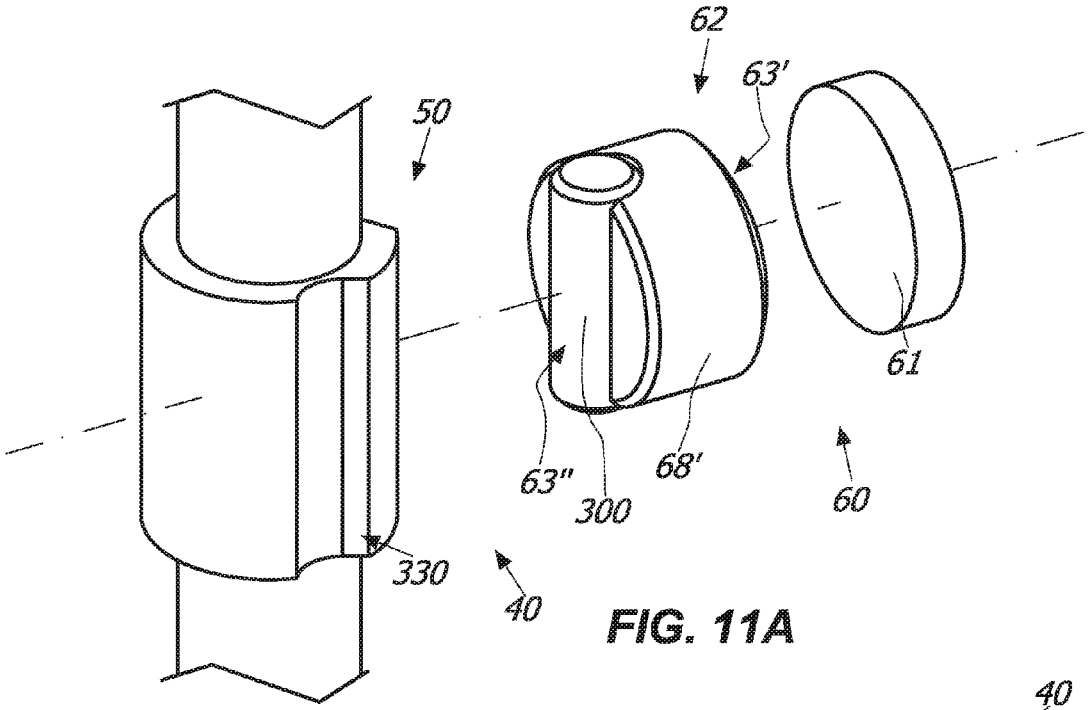
FIGS. 11A and 11B are respectively perspective and partly cut sectional views of some details of the embodiment of the hinge 1 of FIG. 10.
Figure 11B:
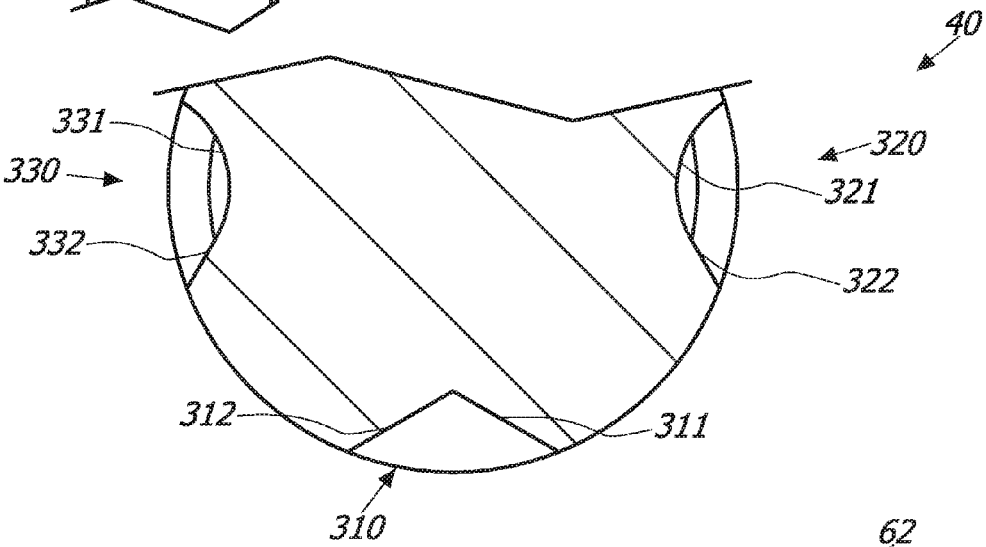
Figure 11B:
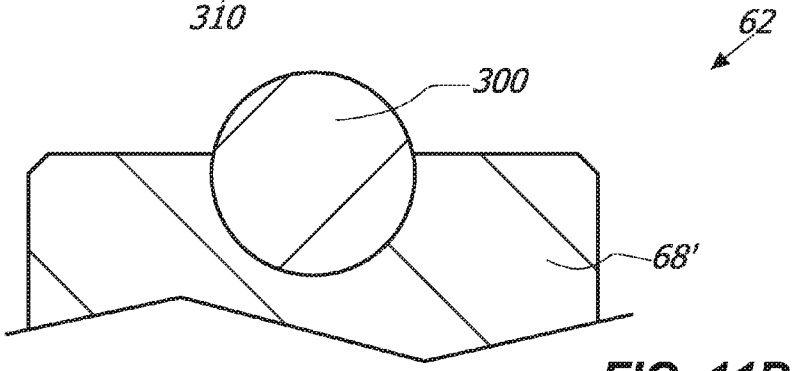
Figure 12A:
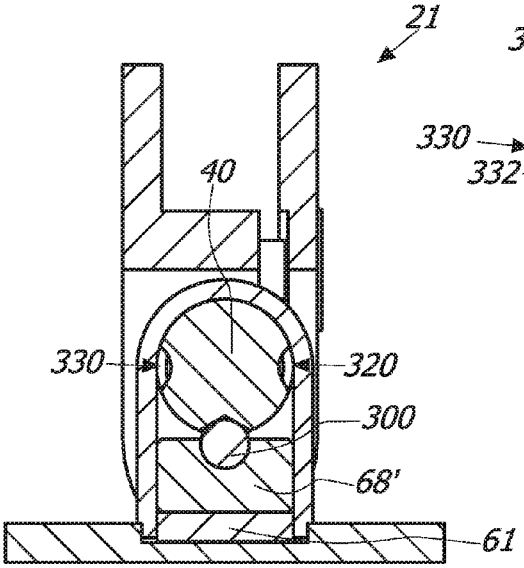
FIG. 12A is a sectional view of the embodiment of the hinge 1 of FIG. 10 in a first operating step.
Figure 12B:
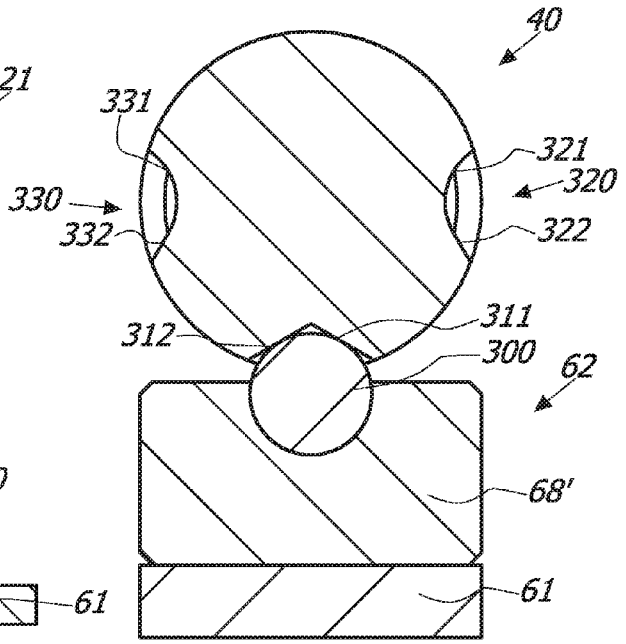
FIG. 12B is an enlarged view showing the relative position of the cam means 50 of FIG. 12A, the pushing member 68' and the elastic counteracting element 61.

Furtherly, the connecting portions 17'" of the working chamber 14 and the corresponding operating portion 75 of the bushing 70 cooperate with each other to allow the partial rotation of the bushing 70, in such a way as to vary the inclination of the axis Y, and therefore the closed door position, as particularly shown in FIG. 8C.

From the above description, it is apparent that the hinge 1 fulfils the intended objects.

The hinge 1 is susceptible to many changes and variants. All particulars may be replaced by other technically equivalent elements, and the materials may be different according to the needs, without exceeding the scope of the invention defined by the appended claims.

The invention claimed is:

1. A hinge for coupling a door and a stationary support structure, the hinge comprising:

a fixed element to be coupled to the stationary support structure; and a movable element to be coupled to the door, the fixed element and the movable element being rotatably coupled each other to rotate about a first longitudinal axis between one or more open positions and a closed position;

wherein one of said movable element and fixed element includes a hinge body, the other of said movable element and fixed element including a pivot defining said first axis, the pivot including a cam member rotating relative to the hinge body about the first axis, said hinge body including at least one working chamber defining a second longitudinal axis perpendicular to said first axis, said at least one working chamber including a follower member interacting with said cam member, the follower member sliding along said second axis between a first and a second end stroke position;

wherein said follower member includes at least one elastic counteracting element and at least one interface element having a first end interacting with said at least one elastic counteracting element and a second end interacting with said cam member, said at least one elastic counteracting element including an elastomer body;

wherein said cam member includes a plurality of flat faces parallel to said first axis, said flat faces being perpendicular to each other, said second end of said at least one interface element including at least one planar operating surface in contact engage with each one of said flat faces of said cam member along a respective contact surface;

wherein the contact surfaces between said at least one planar operating surface and said flat faces have a respective first width, said pivot having a diameter, the ratio between the first widths of said contact surfaces and the diameter of said pivot being not less than 0.8.

2. The hinge according to claim 1, further including a bushing transversely movable within said working chamber with a tubular portion faced to said cam member and an operating portion faced to said elastic counteracting element for cooperating with a corresponding guide surface of said working chamber, said bushing further including a central hole for housing at least partly said interface element and a pair of peripheral slanted portions.

3. The hinge according to claim 2, further including a pair of adjusting screws acting on said slanted portions to move transversely said bushing in said working chamber so as to vary the angle of said central hole with respect to said second axis.

4. The hinge according to claim 3, wherein said operating portion of said bushing and said guide surface of said working chamber are both rounded.

5. The hinge according to claim 4, wherein said working chamber includes a first cylindrical portion facing said cam member having a predetermined inner diameter and a generally rectangular-shaped second portion facing said at least one elastic counteracting element having a predetermined transverse dimension and height, said bushing being placed within said second portion of said working chamber.

6. The hinge according to claim 5, wherein said tubular portion of said bushing has a predetermined outer diameter and height, said second portion of said working chamber including a pair of substantially flat upper and lower walls faced to each other, said tubular portion of said bushing having upper and lower substantially flat surfaces susceptible to transversely slide along said substantially flat upper and lower walls of said second portion of said working chamber in response to the action of a user on said adjusting screws.

7. The hinge according to claim 6, wherein the height of said tubular portion of said bushing is substantially equal to the height of said second portion of said working chamber, the outer diameter of said tubular portion of said bushing being slightly lower than said transverse dimension of said second portion of said working chamber for allowing the transverse movement of said bushing.

8. The hinge according to claim 7, wherein said working chamber includes a connecting portion interposed between said first cylindrical portion and second cylindrical portion which includes said guide surface.

9. The hinge according to claim 1, wherein said elastomer is a compact polyurethane.

10. The hinge according to the claim 1, wherein said elastomer has a Shore A hardness of 50 ShA to 95 ShA.

11. The hinge according to claim 1, wherein said ratio between the lengths of said contact surfaces and the diameter of said pivot is equal to or greater than 0.85.

12. The hinge according to claim 1, wherein said fixed element includes said hinge body, said movable element including said pivot, said cam member being made in the central portion of the pivot.

13. A hinge for coupling a door and a stationary support structure, the hinge comprising:

a fixed element to be coupled to the stationary support structure; and a movable element to be coupled to the door, the fixed element and the movable element being rotatably coupled each other to rotate about a first longitudinal axis between one or more open positions and a closed position;

wherein one of said movable element and fixed element includes a hinge body, the other of said movable element and fixed element including a pivot defining said first axis, the pivot including a cam member rotating relative to the hinge body about the first axis, said hinge body including at least one working chamber defining a second longitudinal axis perpendicular to said first axis, said at least one working chamber including a follower member interacting with said cam member, the follower member sliding along said second axis between a first and a second end stroke position;

wherein said follower member includes at least one elastic counteracting element and at least one interface element having a first end interacting with said at least one elastic counteracting element and a second end interacting with said cam member, said at least one elastic counteracting element including an elastomer body;

wherein said cam member includes a plurality of flat faces parallel to said first axis, said flat faces being perpendicular to each other, said second end of said at least one interface element including at least one planar operating surface in contact engage with each one of said flat faces of said cam member along a respective contact surface;

wherein the contact surfaces between said at least one planar operating surface and said flat faces have a respective first width, said pivot having a diameter, the ratio between the first widths of said contact surfaces and the diameter of said pivot being not less than 0.8;

wherein a non-flat connecting portion is interposed between each couple of consecutive flat faces, each connecting portion having a second width, the ratio between said second width and said first width being not greater than 0.2.

* * * * *